US007331305B2

(12) United States Patent
Garelick

(10) Patent No.: US 7,331,305 B2
(45) Date of Patent: Feb. 19, 2008

(54) DEVICE FOR MOUNTING BOAT APPARATUS TO BOAT DECK

(75) Inventor: Richard J. Garelick, Minneapolis, MN (US)

(73) Assignee: Garelick Mfg. Co., St. Paul Park, MN (US)

( * ) Notice: Subject to any disclaimer, the term of this patent is extended or adjusted under 35 U.S.C. 154(b) by 194 days.

(21) Appl. No.: 11/029,772

(22) Filed: Jan. 5, 2005

(65) Prior Publication Data

US 2006/0144315 A1 Jul. 6, 2006

(51) Int. Cl.
*B63B 17/00* (2006.01)
*A47C 3/20* (2006.01)

(52) U.S. Cl. ..... 114/363; 114/364; 297/344.12

(58) Field of Classification Search ..... 114/343, 114/363, 364; 297/344.1, 344.12; 248/539, 248/158, 159, 188, 501–503.1
See application file for complete search history.

(56) References Cited

U.S. PATENT DOCUMENTS 901,561 A * 10/1908 Searing ..... 248/501
2,429,190 A * 10/1947 McArthur ..... 403/323
2,450,213 A * 9/1948 Turner ..... 248/502
4,789,126 A * 12/1988 Rice et al. ..... 248/503.1
4,955,575 A * 9/1990 Moore ..... 248/398
5,385,323 A * 1/1995 Garelick ..... 248/161
5,431,362 A * 7/1995 Carnahan et al. ..... 248/159
5,497,965 A * 3/1996 Mathieu, Jr. ..... 248/159
5,826,850 A * 10/1998 Goldsmith ..... 248/415
5,975,822 A * 11/1999 Ruff ..... 411/553
6,116,183 A * 9/2000 Crow et al. ..... 114/363
6,254,054 B1 * 7/2001 Few ..... 248/503.1
7,013,831 B1 * 3/2006 Garelick ..... 114/364

* cited by examiner

*Primary Examiner*—Ajay Vasudeva

(57) ABSTRACT

For removably coupling a boat apparatus, such as a boat seat or table, to a boat deck, a base plate having a clamping slot is attached to the boat deck and the boat seat or table or the like is supported by a base assembly having a clamping bolt. The base assembly is placed over the base plate with the clamping bolt engaged in the clamping slot and a manually operable member on the base assembly is manually operated to releasably clamp the bolt securely in place in the associated slot.

8 Claims, 6 Drawing Sheets

DEVICE FOR MOUNTING BOAT APPARATUS TO BOAT DECK

FIELD OF THE INVENTION

The invention is aimed at providing a device for releasably securely mounting a boat apparatus, typically which may be a boat seat or a table, to the boat deck in a manner so that wobble is minimized yet it is relatively easy and convenient to remove the apparatus from the mounting device. As a feature, the mounting device has a very low profile so after the apparatus has been removed the mounting device is not an obstruction on the boat deck.

DESCRIPTION OF THE PRIOR ART

Typical deck mounting devices are illustrated in U.S. Pat. No. 5,385,323 by Garelick. As illustrated in FIG. 1 of the '323 patent, one type of mounting device, referred to as a surface mount, has a base member having a central opening for receiving the bottom end of a seat-supporting rigid tubular pedestal or stanchion with the base member having a flange which rests on the top surface of the boat deck and is rigidly secured to the boat deck by a set of bolts suitably spaced around the base flange. Another low profile mounting device, as illustrated in FIG. 4 of the '323 patent, is referred to as a flush mount which comprises a base member having an annular rigid plate member which is recessed into a support surface such as the boat deck and is secured in place by a series of bolts. A similar stanchion or pedestal is secured at its lower end in the annular opening of the plate member and extends upward to support a boat apparatus, in the illustrated example a table top, at its upper end. The present invention is aimed at providing a secure, virtually wobble-free low profile mounting device on the boat deck yet allowing the apparatus which is attached to the mounting device to be conveniently removed if desired.

SUMMARY OF THE INVENTION

The present invention has a low profile base plate which is fixedly attached to the boat deck. The top of the base plate contains a slot. A base assembly in the form of a rigid cast or molded or machined spider rests on top of the base plate and has a clamping device extending downward from its underside for engaging the slot in the base plate. The base assembly has a generally centrally located annular opening to which the underside of a boat apparatus, such as a boat seat or table or the like, can be coupled. When the base plate assembly is located at the desired position with the clamping device engaging the base slot, a manually operable member, such as a lever arm which is attached in some fashion to the base assembly and is mechanically coupled to the clamping device, is operated to secure the clamping device in the base slot to securely hold the base assembly onto the base plate. To remove the boat apparatus the clamping device is manually released and the base assembly is moved to disengage the clamping device from the base plate slot and the base assembly with the coupled or attached boat apparatus is lifted or slid off the base plate.

As a feature, the top of the base plate has a pair of parallel grooves, one on each side of the clamping slot, and the base assembly has a pair of protrusions on its underside for engaging the respective grooves on the top surface of the base plate. When the base assembly is clamped onto the base plate the resulting frictional engagement between the sides of the grooves and their mating protrusions further secures the base plate and base assembly to one another to further minimize any possible wobble between the two members.

As a further feature, a spring-loaded guide pin extends downward from the base assembly and the base plate has a détent opening for receiving the guide pin. In practice the base assembly is moved along the base plate until the guide pin enters the détent hole which defines the proper location of the base assembly to the base plate so that it can then be clamped firmly in place. To disengage the base assembly from the base plate the guide pin is manually pulled out of the detent opening.

DESCRIPTION OF THE PREFERRED EMBODIMENTS

Figure 1:
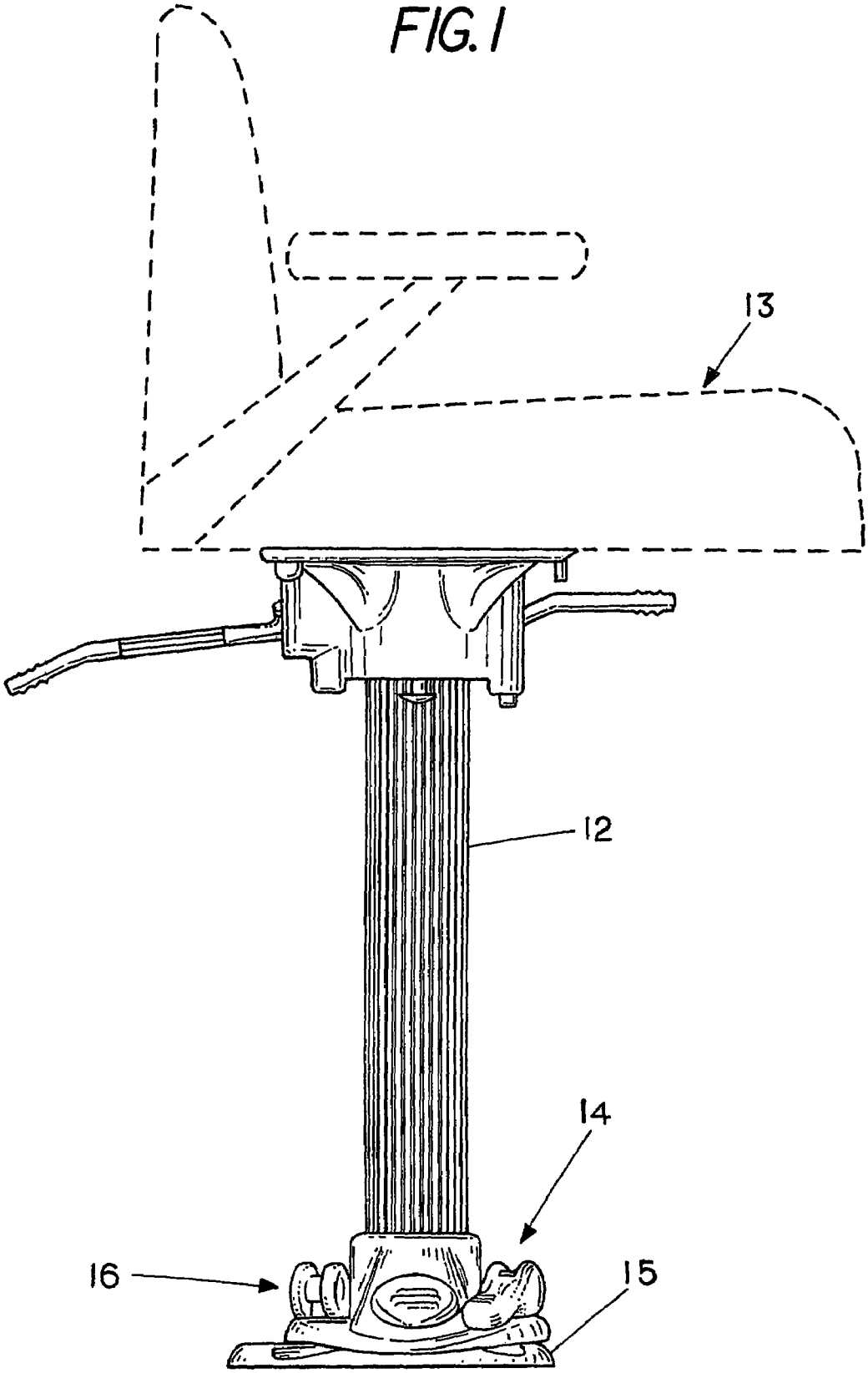
FIG. 1 is a view of an embodiment of the invention used for supporting an elevated boat seat.
Figure 2:
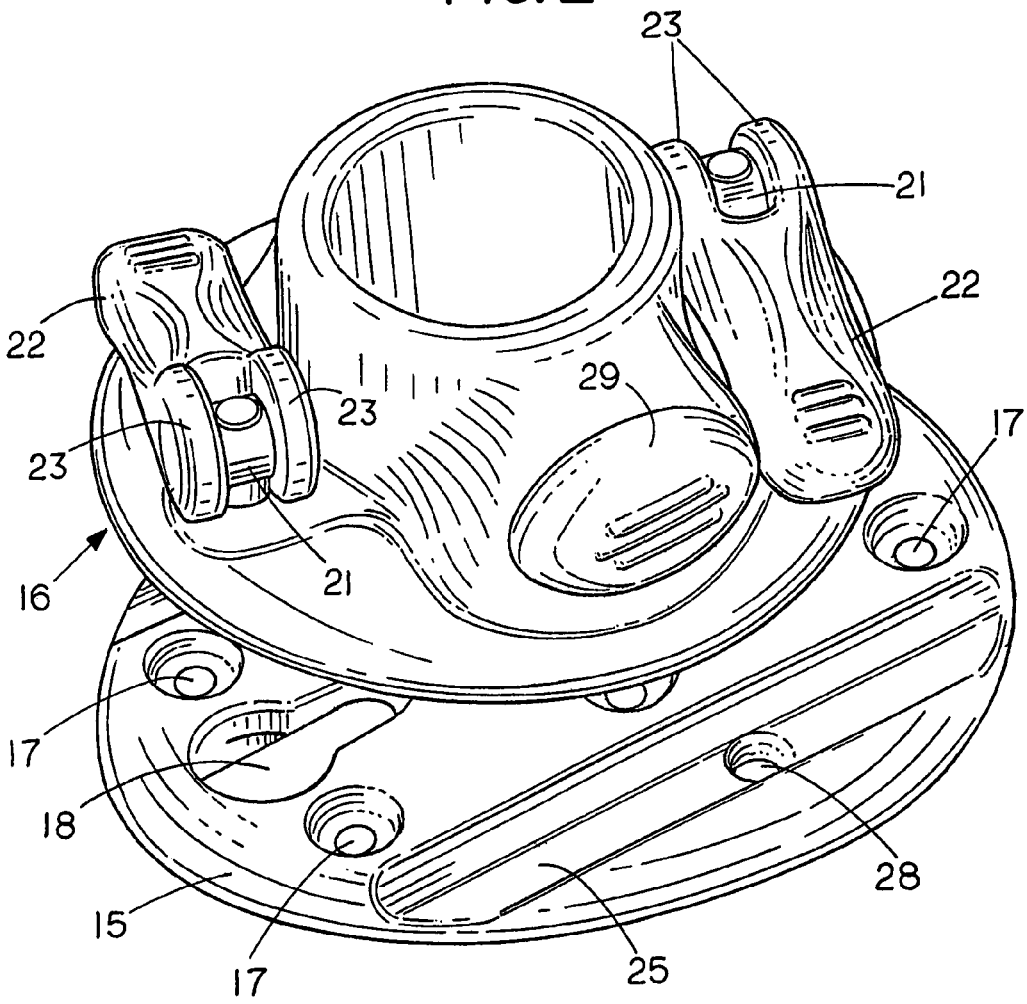
FIG. 2 is a blow-apart assembly of an embodiment of the invention.
Figure 3:
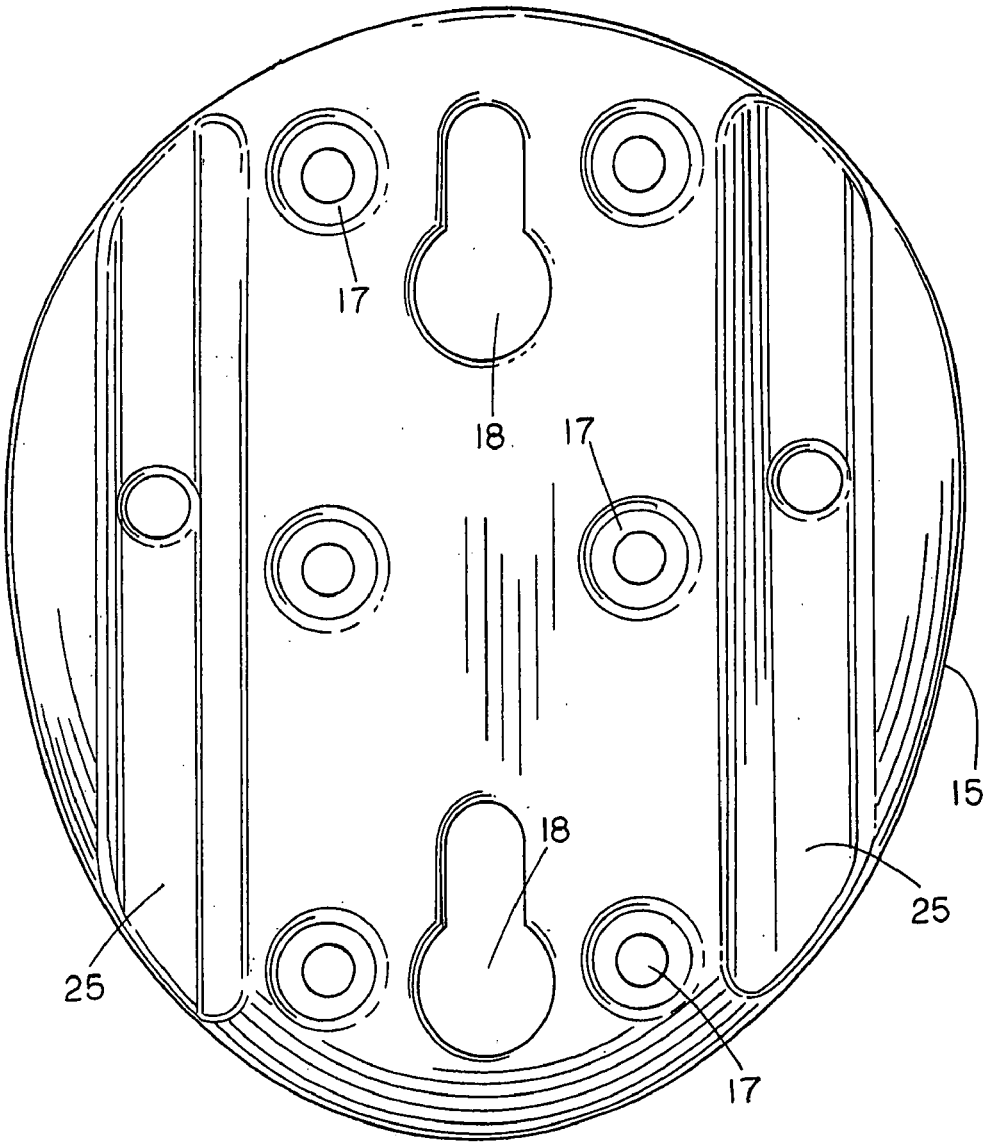
FIG. 3 is a view of the top side of the base plate of the embodiment illustrated in FIG. 2.
Figure 4:
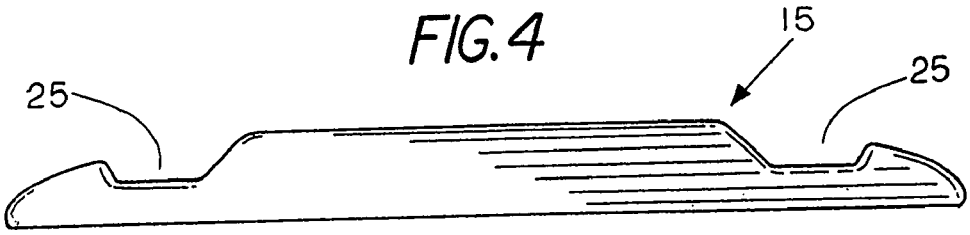
FIG. 4 is a side view of the base plate.
Figure 5:
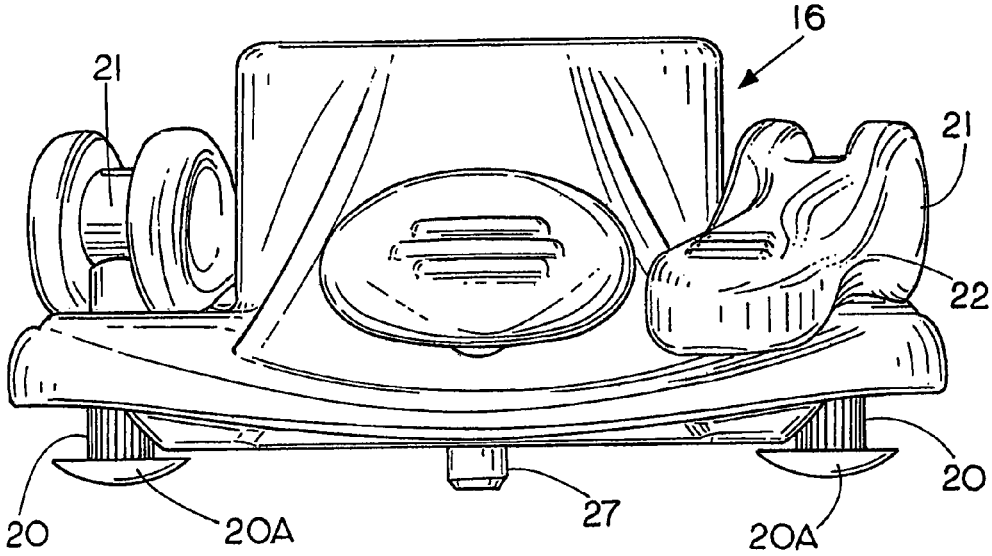
FIG. 5 is what might be designated a plan front view of the base assembly of the embodiment illustrated in FIGS. 1 and 2.
Figure 6:
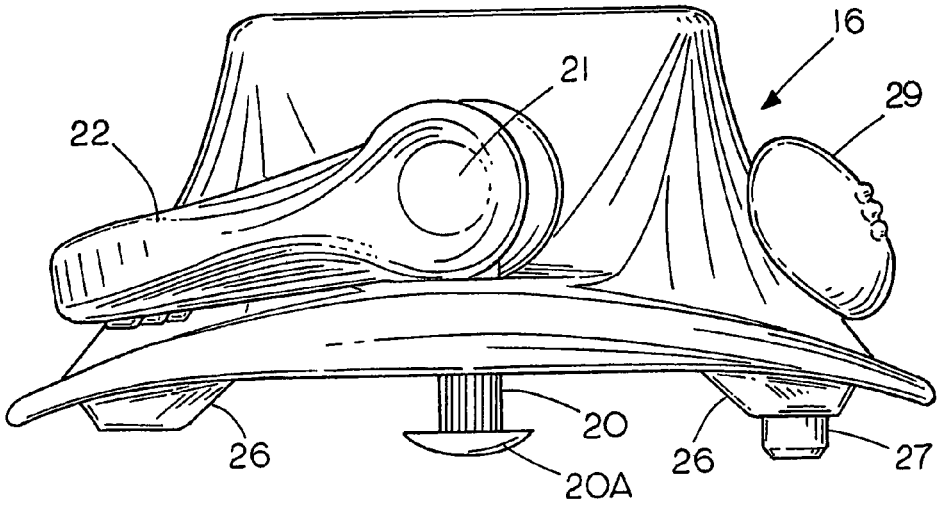
FIG. 6 is aside plan view of FIG. 5.

Typically and conventionally a boat apparatus such as a boat seat 10 is mounted in an elevated position onto a boat deck (not shown) by a rigid tubular support 12 sometimes referred to interchangeably as a pedestal or stanchion. The top end of pedestal 12 is coupled to the underside of the boat seat 10 by a suitable mechanism generally designated by reference numeral 13 which permits the user to adjust the seat position fore and aft as well as swivel or rotate it to face in a desired direction. In addition, conventionally there is provided means, not shown, for adjusting the height or elevation of the seat. The present invention provides a mechanism for attaching or coupling the underside of the boat seat to the boat deck in a manner to minimize the amount of a wobble that might otherwise occur at the mounting mechanism and yet permit the boat seat to be conveniently and readily removed from the mounting mechanism when desired. The mounting mechanism 14 comprises a base plate 15 which rests on the surface of the deck and a base assembly 16 which rests on the top side of base plate 15. Base plate 15 is secured or attached to the deck by bolts, not shown, through a series of recessed holes 17. Base plate 15 has a pair of aligned slots 18 which in the illustration of FIGS. 1-3 are in the form and shape of a key slot. Extending downward from the underside of base assembly 16 are a pair of aligned clamping rods or bolts 20 for engaging slots 18 and for releasably securing the base assembly 16 to base plate 15. The base assembly 16 is secured or clamped to the base plate 15 by first placing base assembly 16 so that the respective heads 20A of clamping bolt 20 engage the larger section of the respective keyway slots 18 and then is slid or moved so that the shafts of clamping bolts 20 enter the narrower section of the key slots 18 and are then clamped securely in place within the respective slots. In the embodiment illustrated in FIGS. 1, 2, 5 and 6 each of the clamp bolts 20 is threaded into the barrel 21 at the end of a lever arm 22 which has cammed curved surfaces 23 on each side of barrel 21. In the illustrated embodiment, lever arms 22 are raised to unclamp the base assembly 16 from base plate 15 so that base assembly 16 can be moved to place the clamping bolts into the respective slots 18. When in place lever arms 22 are swung downward to draw up bolts 20 by virtue of their attachment to barrels 21 and the action of the cammed curved surfaces 23 so that the bolt heads 20A clamp securely in their respective slots 18 to clamp base assembly 16 to base plate 15. Depending on the manner of the mechanical linkage between the bolts 20 and the barrels 21, the bolts can be clamped and released by either raising or lowering lever arms 22.

Figure 8:
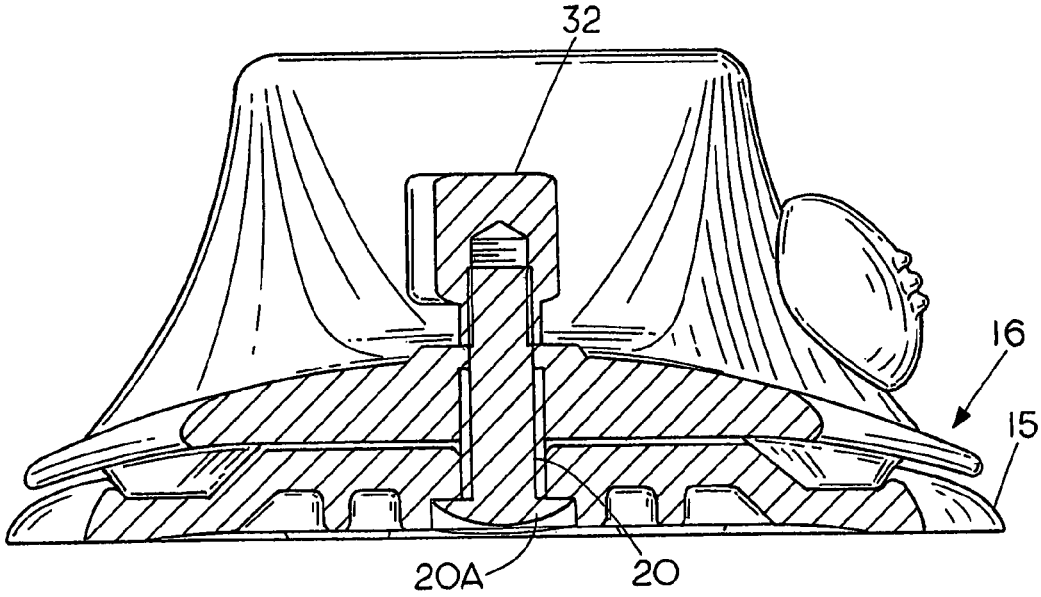
FIG. 8 is a section view illustrating an alternate manner of manually clamping.

Alternatively, clamping bolts 20 may be moved by other mechanical means, e.g., by a threaded member such as a threaded knob. FIG. 8 illustrates knob 32 which is threaded to clamp bolt 20 to raise and lower it as necessary to clamp or unclamp it in its slot as described hereinabove.

Figure 9:
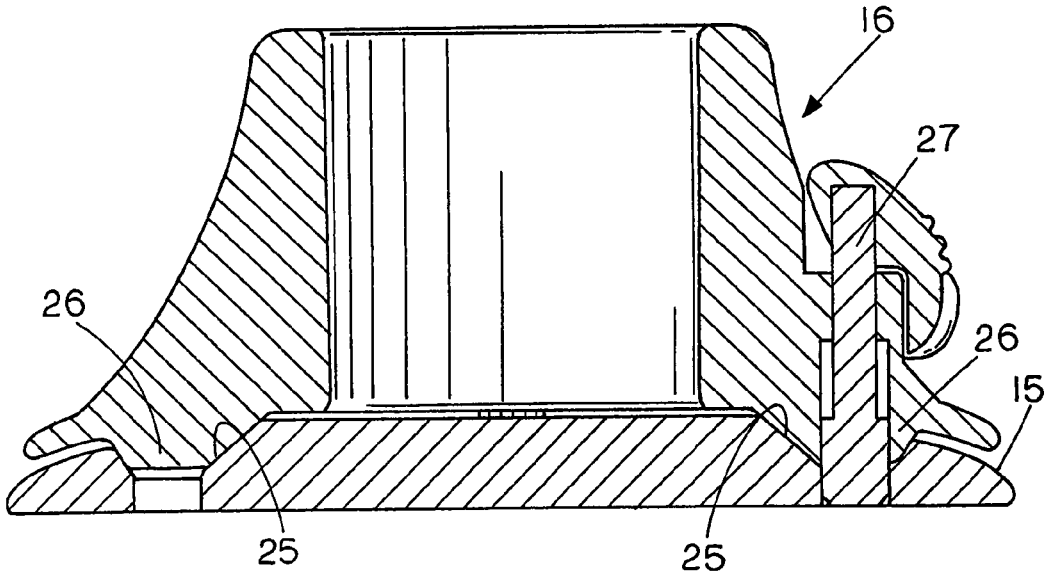
FIG. 9 is a section view showing greater detail of the clamping.

To aid in securely holding the base assembly 16 onto the base plate 15 and to minimize any wobble, the latter has a pair of elongated grooves or recesses 25 on its upper side which are parallel to one another and to the lengthwise alignment of slots 18 and, correspondingly, the underside of base assembly 16 has downward extending protrusions 26 for engaging grooves 25 when base assembly 16 is placed on base plate 15. When lever arms 22 are moved to clamp the base assembly to the base plate, as described hereinabove, the frictional engagement between the sides of grooves 25 and the associated protrusions 26, see FIG. 9, further aids to tightly clamp the two members together and provide additional protection against any wobble effect between the base assembly 16 and the base plate 15.

To assist the user in suitably locating the clamping bolts 20 within their respective slots 18, a downwardly extending guide pin 27 is provided on base assembly 16 and a corresponding détent aperture or hole 28 is suitably located on the base plate 15. The guide pin 27 is spring-loaded downward and is manually raised upward out of engagement with détent 28 by a manually operated pusher 29. In practice, the base assembly 16 is placed on the base plate 15 with the lower protrusions 26 engaged in the grooves 25 and moved along until the heads 20A of clamp bolts 20 engage the larger section of the key slots 18 and then further moved so that the locking bolts slide into the narrower section of key slots 18 for clamping. The guide pin 27 and détent hole 28 are located so when the former snaps into the latter, the operator then knows that the clamping bolts are in the correct position for clamping the base assembly onto the base plate 15.

Figure 7:
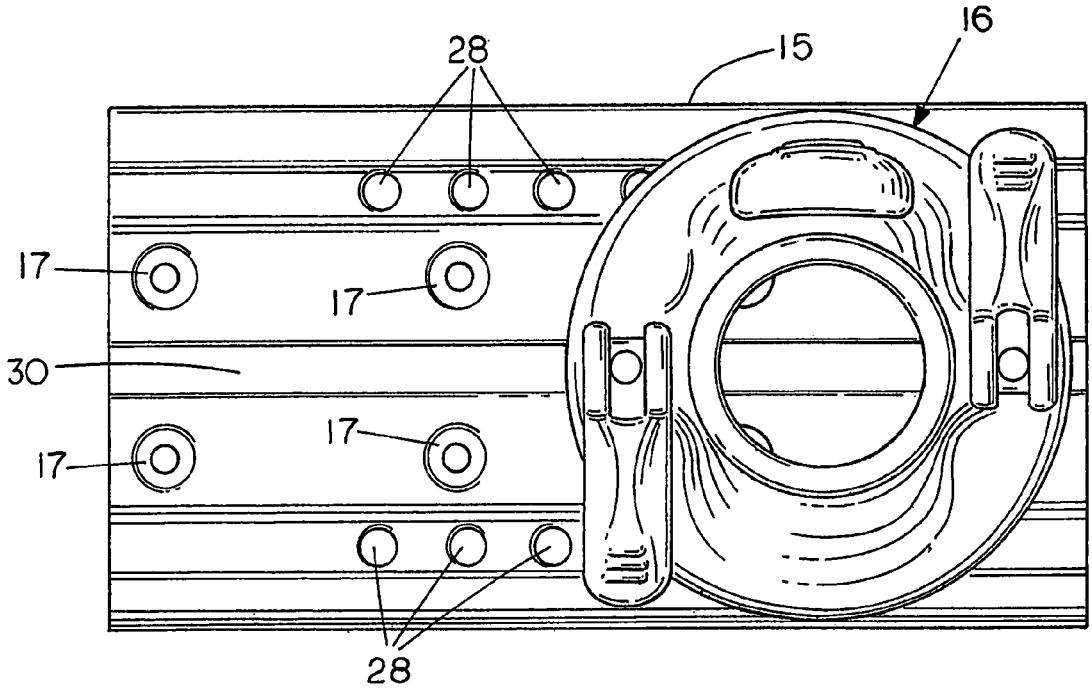
FIG. 7 is a top view showing a variation of the base plate having an elongated clamping slot.

As illustrated in FIG. 7, base plate 15 may be provided with a clamping slot 30 which is an elongated slot as differentiated from the key-style slots 18. When placing the base assembly onto the base plate the clamping bolts 20 are inserted at the outer end of elongated slot 30 and the base assembly 16 moved along the slot 30 until the locating pin engages the détent hole 28 signaling that the assembly is in the desired location and then the lever arms are moved to lock the clamping bolts in place in slot 30. Associated with elongated slot 30 are a series of spaced-apart additional detent holes 28 for accommodating guide pin 27 so that base assembly (with attached seat or the like) can be conveniently moved to different locations as desired along slot 30 as an adjustment feature.

I claim:

1. A boat mounted device for removably coupling boat apparatus to the deck of a boat, comprising:

a) a base plate, said base plate securable to a boat deck, said base plate having a slot formed on its top surface;

b) a base assembly, engageable with the top of said base plate, said base assembly having an opening coupling the base assembly to the underside of a boat apparatus;

c) a clamping device extending from the bottom of said base assembly, said clamping device engaging the base plate slot when said base assembly is engaged with said base plate;

d) a manually operable member mounted on said base assembly engaged with said clamping device releasably tightly securing said clamping device in said base plate slot;

e) a pair of parallel grooves on top of said base plate; and f) a pair of corresponding protrusions on the underside of said base assembly, said protrusions tightly engaging said grooves when said clamping device is tightly secured in said base plate.

2. The boat mounted device as described in claim 1 wherein said base plate slot is in the form of a key slot.

3. The boat mounted device as described in claim 1 wherein said base plate slot is an elongated slot.

4. The boat mounted device as described in claim 1 further including a rigid pedestal for engaging said base assembly opening at one end and extending upward from said base assembly for engaging the underside of a boat apparatus at the other end.

5. The boat mounted device as described in claim 1 wherein said manually operable member releasably securing the clamping device comprises a lever arm.

6. The boat mounted device as described in claim 1 further including a pin extending downward from said base assembly and a detent opening in said base plate, said pin engaging said detent opening when said base assembly is in a desired position for clamping.

7. The boat mounted device as described in claim 6 wherein said base plate has a plurality of detent openings.

8. The boat mounted device as described in claim 6 wherein said pin includes means for manually disengaging said pin from the detent opening.

* * * * *